US009877121B2

(12) United States Patent
Hillbratt et al.

(10) Patent No.: US 9,877,121 B2
(45) Date of Patent: Jan. 23, 2018

(54) CONTROL BUTTON CONFIGURATIONS FOR AUDITORY PROSTHESES

(71) Applicants: Martin Evert Gustaf Hillbratt, Macquarie University (AU); Kristian Gunnar Asnes, Macquarie University (AU); Johan Gustafsson, Macquarie University (AU)

(72) Inventors: Martin Evert Gustaf Hillbratt, Macquarie University (AU); Kristian Gunnar Asnes, Macquarie University (AU); Johan Gustafsson, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

(21) Appl. No.: 14/887,608

(22) Filed: Oct. 20, 2015

(65) Prior Publication Data

US 2016/0112813 A1 Apr. 21, 2016

Related U.S. Application Data

(60) Provisional application No. 62/066,176, filed on Oct. 20, 2014.

(51) Int. Cl.
*H04R 25/00* (2006.01)
*H04R 9/02* (2006.01)
(Continued)

(52) U.S. Cl.
CPC ..... *H04R 25/606* (2013.01); *H04R 9/025* (2013.01); *H04R 9/066* (2013.01); *H04R 11/04* (2013.01);
(Continued)

(58) Field of Classification Search
CPC ..... H04R 1/46; H04R 9/025; H04R 11/02; H04R 11/04; H04R 13/00; H04R 25/606;
(Continued)

(56) References Cited

U.S. PATENT DOCUMENTS 7,809,147 B2 * 10/2010 Giannetti ..... H04R 1/46 381/151
8,526,641 B2 * 9/2013 Parker ..... H04R 25/70 381/151
(Continued)

FOREIGN PATENT DOCUMENTS

KR 10-2011-0105588 A 9/2011

OTHER PUBLICATIONS

PCT International Search Report and Written Opinion in International Application PCT/IB2015/002172, dated Mar. 28, 2016, 11 pgs.

*Primary Examiner* — Huyen D Le
(74) *Attorney, Agent, or Firm* — Merchant & Gould P.C.

(57) ABSTRACT

A button on an auditory prosthesis is aligned with a shaft and a bone anchor of the prosthesis. Forces resulting from pressing of the button are evenly distributed towards the anchor, which prevents damage to the prosthesis. The button can be connected to the prosthesis housing with a flexible element or seal, which acts as a soft mute function when the button is pressed, further reducing the risk of feedback. Dampers can be incorporated into the button structure to further dampen feedback that can be transmitted to other components of the auditory prosthesis.

11 Claims, 9 Drawing Sheets

(51) Int. Cl.
*H04R 11/04* (2006.01)
*H04R 9/06* (2006.01)

(52) U.S. Cl.
CPC ..... *H04R 25/608* (2013.01); *H04R 2225/61* (2013.01); *H04R 2225/67* (2013.01); *H04R 2460/13* (2013.01)

(58) Field of Classification Search
CPC ..... H04R 25/65; H04R 2225/61; H04R 2460/13; H04R 9/066; H04R 2225/67
USPC ..... 381/326, 328, 330, 151, 380, 381, 396, 381/412, 417, 418; 600/25; 607/55, 56, 607/57
See application file for complete search history.

(56) References Cited

U.S. PATENT DOCUMENTS

| | | | |
|---|---|---|---|
| 2009/0138062 | A1 | 5/2009 | Balslev |
| 2012/0108887 | A1 | 5/2012 | Vermeiren |
| 2014/0163309 | A1 | 6/2014 | Bernhard et al. |
| 2014/0275731 | A1 | 9/2014 | Andersson et al. |

* cited by examiner

CONTROL BUTTON CONFIGURATIONS FOR AUDITORY PROSTHESES

BACKGROUND

An auditory prosthesis is placed on the skull to deliver a stimulus in the form of a vibration to the skull of a recipient. These types of auditory prosthesis are generally referred to as bone conduction devices. The auditory prosthesis receives sound via a microphone. The sound is processed and converted to electrical signals, which are delivered by an actuator as a vibration stimulus to the skull of the recipient. In certain audio prostheses, the actuator is an electromagnetic actuator, for example a variable reluctance electromagnetic actuator. Regardless of the type of actuator, it is quite common for a recipient to experience feedback and distortion when operating the buttons. Additionally, if a recipient is not careful when pressing the button on her prosthesis, she may twist the housing of the device, which can damage internal components, thus leading to reduced therapy efficiency.

SUMMARY

A button on an auditory prosthesis can be aligned with a shaft that connects the prosthesis to a recipient, at a bone anchor. By aligning the button with the shaft and bone anchor, forces resulting from pressing the button are evenly distributed towards the anchor, which prevents damage to the prosthesis. Additionally, the button can be connected to the prosthesis housing with a flexible element or seal. The seal acts as a soft mute function when the button is pressed, reducing the risk of feedback. Additional dampers can be incorporated into the button structure to further dampen feedback transmitted to components such as the microphone, which are also located on the housing.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Figure 1:
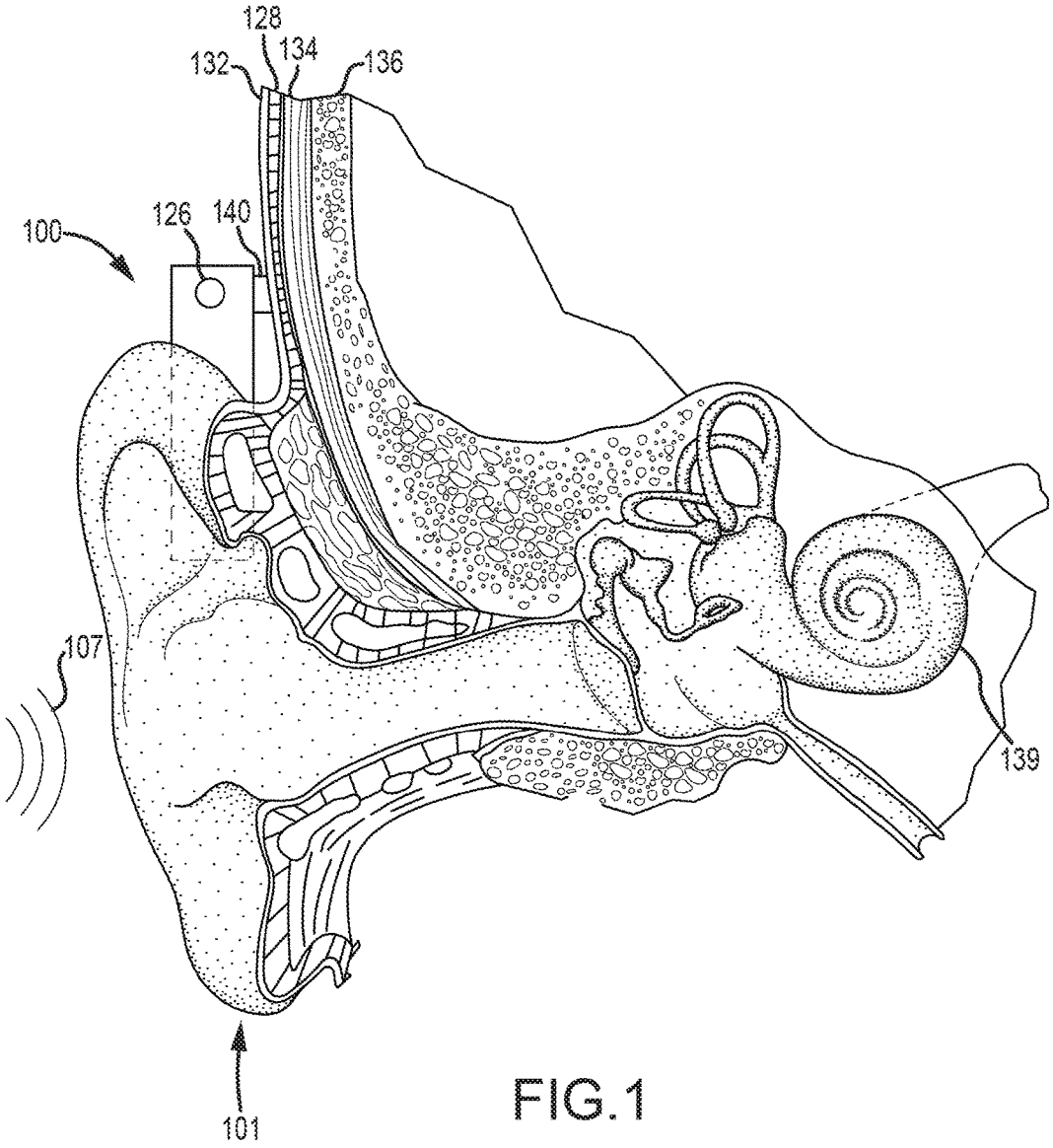
FIG. 1 is a view of a percutaneous bone conduction device worn on a recipient.
Figure 2:
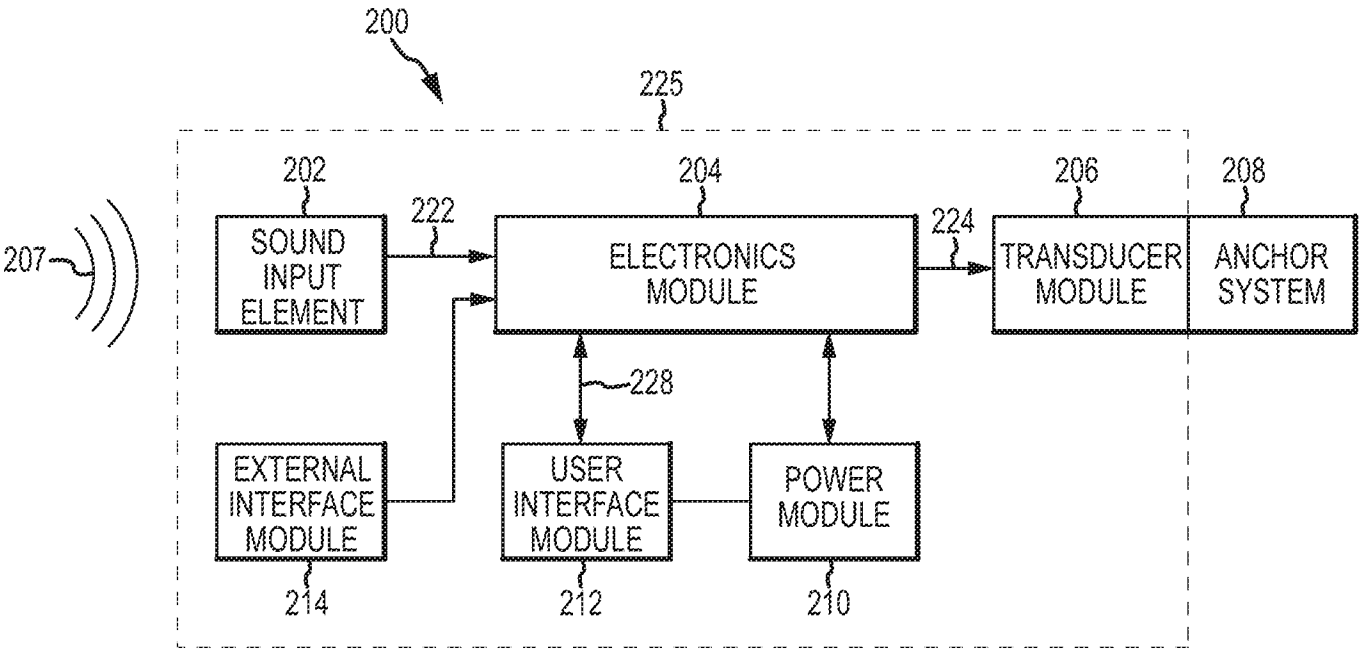
FIG. 2 is a schematic diagram of a percutaneous bone conduction device.

Although FIGS. 1 and 2 depict percutaneous bone conduction devices, where a coupling apparatus is connected to an anchor system implanted within the recipient's skull, the technologies disclosed herein can also be used in passive and active transcutaneous bone conduction devices. In a passive transcutaneous bone conduction device, the actuator is secured to the head with a magnet that interacts with an implanted device, and no anchor passes through the skin. Additionally, an actuator can be adhered to the skin with an adhesive, such that the vibrational forces pass through the skin to the bone. The technologies described herein (e.g., resilient elements, dampers, flexible connectors, etc.) can be used in context of the transcutaneous bone conduction devices, as well as fully implanted bone conduction devices. In general, the technologies described herein can help reduce or eliminate feedback and distortion in any device that delivers a vibration stimulus to a recipient. Additionally, by disposing a control button or an auditory prosthesis as described, moment forces applied to the prosthesis can also be reduced, thus preventing inadvertent damage to the prosthesis or components disposed therein. Notwithstanding the great variability of devices in which the described technologies can be implemented, for clarity, the technologies will be described generally herein in the context of percutaneous bone conduction devices.

FIG. 1 is a perspective view of a percutaneous bone conduction device 100 positioned behind outer ear 101 of the recipient that comprises a sound input element 126 to receive sound signals 107. The sound input element 126 can be a microphone, telecoil or similar. In the present example, sound input element 126 can be located, for example, on or in bone conduction device 100, or on a cable extending from bone conduction device 100. Also, bone conduction device 100 comprises a sound processor (not shown), a vibrating electromagnetic actuator and/or various other operational components.

In embodiments, sound input device 126 converts received sound signals into electrical signals. These electrical signals are processed by the sound processor. The sound processor generates control signals that cause the actuator to vibrate. In other words, the actuator utilizes a mechanical force to impart vibrations to skull bone 136 of the recipient.

Bone conduction device 100 further includes coupling apparatus 140 to attach bone conduction device 100 to the recipient. In the example of FIG. 1, coupling apparatus 140 is attached to an anchor system (not shown) implanted in the recipient. An exemplary anchor system (also referred to as a fixation system) can include a percutaneous abutment such as a bone screw fixed to the recipient's skull bone 136. The abutment extends from skull bone 136 through muscle 134, fat 128, and skin 132 so that coupling apparatus 140 can be attached thereto. Such a percutaneous abutment provides an attachment location for coupling apparatus 140 that facilitates efficient transmission of mechanical force.

A functional block diagram of one example of a bone conduction device 200 is shown in FIG. 2. Sound 207 is received by sound input element 202. In some arrangements, sound input element 202 is a microphone configured to receive sound 207, and to convert sound 207 into electrical signal 222. Alternatively, sound 207 is received by sound input element 202 as an electrical signal.

As shown in FIG. 2, electrical signal 222 is output by sound input element 202 to electronics module 204. Electronics module 204 is configured to convert electrical signal 222 into adjusted electrical signal 224. As described below in more detail, in certain embodiments, electronics module 204 can include a sound processor, control electronics, transducer drive components, and a variety of other elements. Additionally, electronics module 204 can also include signal detectors that detect signal sent from other components of the bone conduction device 200.

As shown in FIG. 2, actuator or transducer 206 receives adjusted electrical signal 224 and generates a mechanical output force in the form of vibrations that are delivered to the skull of the recipient via anchor system 208, which is coupled to bone conduction device 200. Delivery of this output force causes motion or vibration of the recipient's skull, thereby activating the hair cells in the recipient's cochlea 139 (depicted in FIG. 1) via cochlea fluid motion.

FIG. 2 also illustrates power module 210. Power module 210 provides electrical power to one or more components of bone conduction device 200. For ease of illustration, power module 210 has been shown connected only to user interface module 212 and electronics module 204. However, it should be appreciated that power module 210 can be used to supply power to any electrically powered circuits/components of bone conduction device 200.

User interface module 212, which is included in bone conduction device 200, allows the recipient to interact with bone conduction device 200. For example, user interface module 212 can allow the recipient to adjust the volume, alter the speech processing strategies, power on/off the device, initiate an actuator balance test, etc. In certain embodiments, the user interface module 212 can include one or more buttons disposed on an outer surface of a housing 225 of the bone conduction device 200. In the example of FIG. 2, user interface module 212 communicates with electronics module 204 via signal line 228.

Bone conduction device 200 can further include an external interface module 214 that can be used to connect electronics module 204 to an external device, such as a fitting system. Using the external interface module 214, the external device can obtain information from the bone conduction device 200 (e.g., the current parameters, data, alarms, etc.) and/or modify the parameters of the bone conduction device 200 used in processing received sounds and/or performing other functions. In embodiments, the external interface module 214 can also be utilized to connect the bone conduction device 200 to an external device such as a home or audiologist computer, or to a smartphone via a wireless (e.g., Bluetooth) connection, so as to perform the actuator balance tests described herein.

Figure 3A:
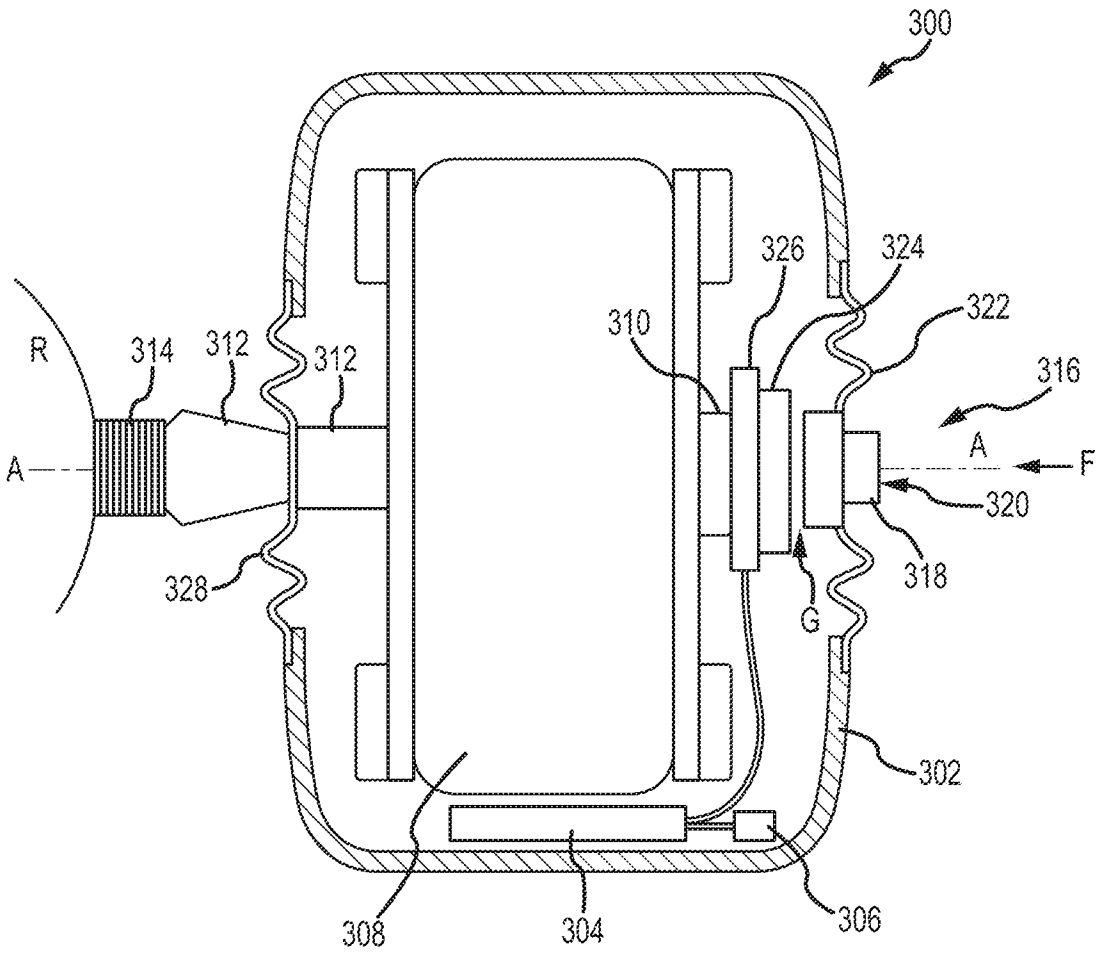
FIGS. 3A-3B are cross-sectional schematic views of embodiments of bone conduction devices, worn on a recipient.

FIG. 3A depicts a cross-sectional schematic view of bone conduction device 300, worn on a recipient R. The bone conduction device 300 includes a housing 302 in which is disposed a number of components and modules, such as those depicted above in FIG. 2. Not all of the components described above are depicted in FIG. 3A, for clarity. The bone conduction device 300 includes an electronics module 304 in communication with a sound input element 306, such as a microphone, which receives a sound input. The electronics module can be a controller that controls settings or operation of the device 300, and can also include detectors for detecting signals sent from other components or modules in the device 300. These components can be resiliently secured to the housing 302 to minimize feedback caused by vibration of a transducer module 308 (in this case, a vibration actuator). The vibration actuator 308 can be substantially annular in shape, so as to define an opening thought which an actuator shaft 310 is disposed. On other embodiments, the vibration actuator can be any desired outer shape and can define a central opening to receive the actuator shaft 310. The actuator shaft 310 transfers vibration stimulus from the vibration actuator 308 to the recipient R, via a coupling element or abutment 312 that connects to a bone anchor 314 anchored in the skull of the recipient R. A control button 316 is used by the recipient R to control the bone conduction device 300. The control button 316 is disposed on the housing 302 and can be flexibly connected thereto. The control button 316 can include a number of sub-parts or elements. The outermost element (relative to the housing 302) is an engagement element 318 that includes an engagement surface 320. The engagement surface 320 is contacted by the recipient R, generally by a pressing action, which generates an axial force F on the control button 316. The engagement element 318 is connected to the housing 302 with a resilient or flexible seal 322, which can be in the form of a bellows or other structure.

In the embodiment of FIG. 3A, the engagement element 318 is separated from the remaining components of the control button 316 by a gap G, when the engagement element 318 is not depressed. The remaining components of the control button 316 include contact element 324 and an input 326 in the form of a circuit board. The input 326 is disposed between the contact element 324 and the actuator shaft 310. When the engagement element 318 is depressed due to application of an axial force F, a signal is sent from the input 326 to the electronics module 304, which is in communication therewith. Once the axial force F is released, the engagement element 318 returns to the position depicted in FIG. 3A, due to the biasing force of the flexible seal 322. In another embodiment, a non-conductive spring can be disposed in the gap G to return the engagement element 318 to its original position. The gap G prevents any signal from being sent from the input 326 to the electronics module 304 in the absence of contact between the elements of the control button 316. A flexible shaft seal 328 can also be disposed about the actuator shaft 310 proximate the abutment 312, so vibrations transmitted by the actuator shaft 310 to the recipient R are not transmitted to the housing 302, further reducing the potential for feedback and distortion.

As can be seen in FIG. 3A, the engagement surface 320, engagement element 318, contact element 324, input 326, actuator shaft 310, abutment 312, and bone screw 314 are all aligned along an axis A. As the actuator shaft 310 is substantially surrounded by the vibration actuator 308, the vibration actuator 308 is also aligned along this same axis A. When the force F is applied to the engagement surface 320, that force F is transmitted along the axis A. The actuator shaft 310, abutment 312, and bone screw 314, provide an axial resistance opposite the force F. This allows the control button 316 to be properly actuated. Additionally, since the engagement surface 320 is axially aligned with the actuator shaft 310, no moment about the shaft 310 is generated by the applied force F. In contrast, prior art auditory prostheses that utilize a control button that is offset from an actuator shaft (or that are disposed on the side of an auditory prosthesis housing) can exert a moment on the prosthesis. This moment can lead to twisting of the housing of the device about the fixation point provided by the actuator shaft and bone screw. This can bend or otherwise deflect springs or other components contained in the prosthesis, which can lead to damage of the components.

Figure 3B:
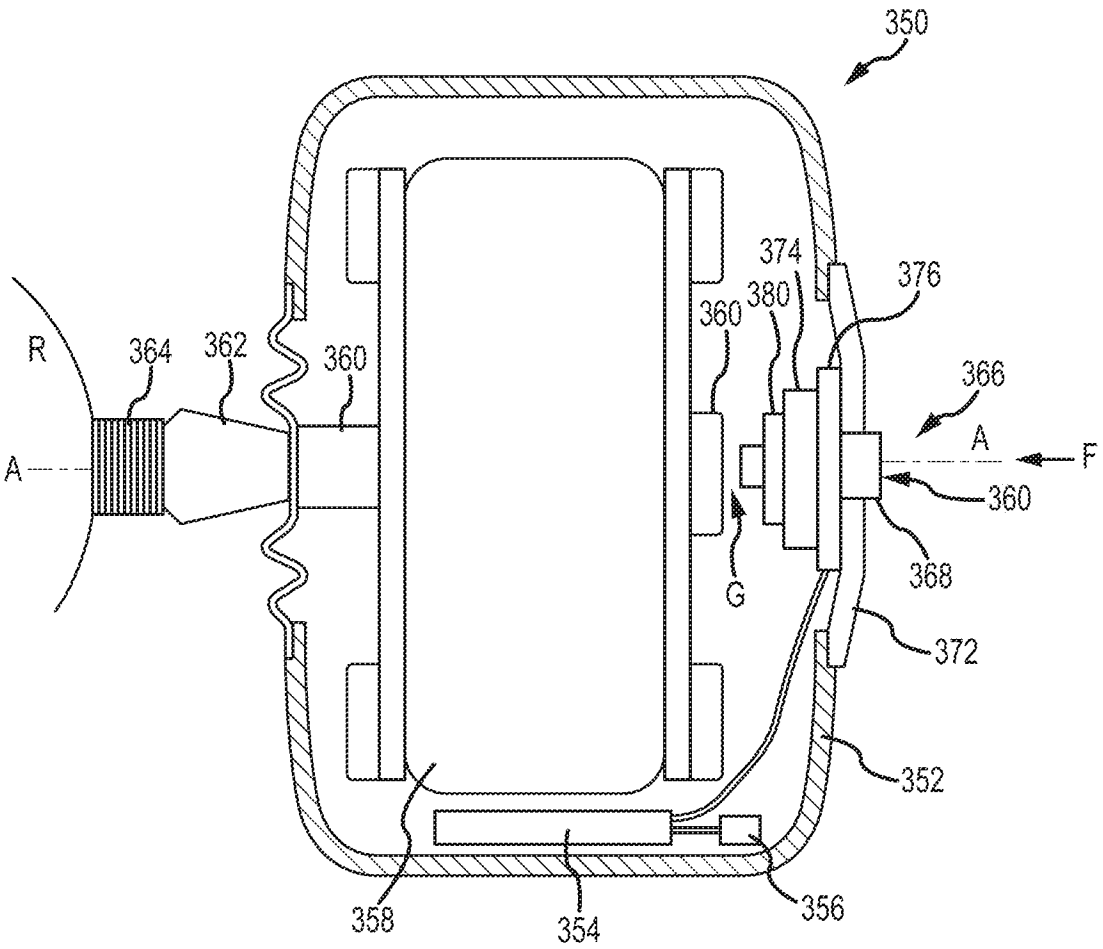

FIG. 3B depicts a cross-sectional schematic view of another embodiment of a bone conduction device 350, worn on a recipient R. The bone conduction device 350 includes a housing 352 in which is disposed a number of components, such as those depicted above in FIG. 2. As with the embodiment of FIG. 3A, not all of the components described in FIG. 2 are depicted. Additionally, certain of the elements described above in FIG. 3A are not necessarily described in detail with regard to FIG. 3B. The bone conduction device 350 includes an electronics module or controller 354 and a sound input element 356, such as a microphone. Both of these components can be resiliently secured to the housing 352 to minimize feedback caused by vibration of a vibration actuator 358. The vibration actuator 358 can substantially surround an actuator shaft 360, which passes from a first side (proximate the recipient R) to a second side (opposite the recipient R) of the vibration actuator 358. The actuator shaft 360 transfers vibration stimulus from the vibration actuator 358 to the recipient R, via a coupling element 362 and a bone screw 364 anchored in the skull of the recipient R. A control button 366 is disposed on the housing 352 and can include a number of sub-parts or elements. The outermost element is an engagement element 368 that includes an engagement surface 370, which is configured to be contacted by the recipient R, generally by a pressing action. This pressing action generates an axial force F. The engagement element 368 is connected to the housing 352 with a semi-resilient or flexible seal 372.

The control button 366 is separated from the actuator shaft 360 by a gap G, when the engagement element 368 is not depressed. Additional elements of the control button 366 include an input 376 and a contract element 374. The input 376 is in contact with the engagement element 368 and the contact element 374 is located on an opposite side of the input 376. Disposed in the gap G is a damper 380, which can also form a component of the control button 366. The damper can be any resilient element that is used to reduce vibration transmission, such as coil springs, leaf springs, torsion springs, shape-memory elements, wave springs, and elastomeric elements. When the engagement element 368 is depressed by application of axial force F, the control button 366 and the actuator shaft 360 are in contact. A signal is sent from the input 376 to the electronics module 354, which is in communication therewith. The damper 380 further reduces vibrations and feedback that can be transmitted from the vibration actuator 358 to the housing 352. Once the axial force F is released, the engagement element 368 returns to the position depicted in FIG. 3B, due to the biasing force of the flexible seal 372. In another embodiment, a non-conductive spring can be utilized to return the engagement element 368 to its original position. The gap G prevents any signal from being sent from the input 376 to the electronics module 354. A flexible shaft seal 378 can also be disposed about the actuator shaft 360 proximate the collar 362, so vibrations transmitted by the actuator shaft 360 to the recipient R are not transmitted to the housing 352, which further reduces the potential for feedback and distortion.

The axial force F is transmitted along the axis A as described above with regard to FIG. 3A. Other configurations of control buttons are contemplated. For example, a damper can be utilized in the embodiment of the bone conduction device depicted in FIG. 3A. Additionally, multiple dampers can be utilized, or a damper can be connected to the actuator shaft instead of forming part of the control button. The engagement elements can be eliminated and the engagement surface (a raised or textured surface, for example) can be formed directly on the flexible seal. The engagement element can also function as the contact element and/or the input. Additionally, a plurality or all of the depicted sub-parts of the control button can be incorporated into a single, unitary component.

Figure 4:
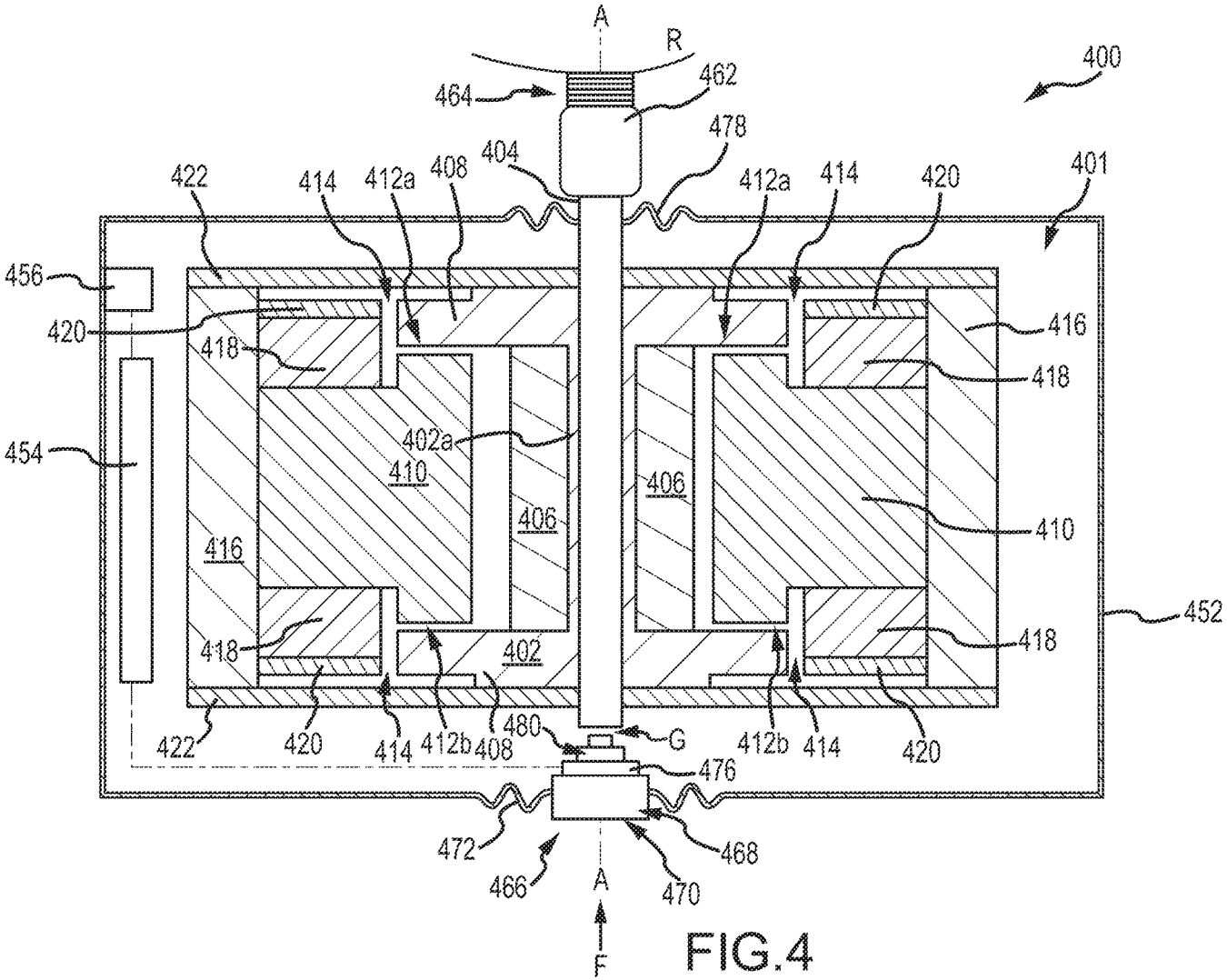
FIG. 4 is a cross-sectional schematic view of an embodiment of a bone conduction device and a vibration actuator, worn on a recipient.

A bone conduction device 400 is depicted in FIG. 4, which also depicts a cross-sectional view of a variable reluctance electromagnetic actuator 401 disposed therein. Of course, other types of vibration actuators, such as piezoelectric or magnetostrictive actuators can be utilized. The transducer or vibration actuator 401 includes a bobbin 402 and an actuator or output shaft 404 that passes through a central opening of the bobbin 402. The output shaft 404 delivers vibrational stimulus to the skull of a recipient R. An electromagnetic coil 406 is wrapped around a portion of the bobbin 402, between plates 408 of the bobbin 402. A yoke 410 surrounds the coil 406 and is disposed between the two plates 408. Axial air gaps 412*a*, 412*b* are disposed between each plate 408 and the yoke 410. Radial air gaps 414 are disposed between ends of the yoke 410 and a counterweight 416. Permanent magnets 418 are disposed between the yoke 410, the counterweight 416, and magnetic rings 420. In embodiments, the bobbin 402, yoke 410, and rings 420 are manufactured from iron or other magnetic metals. Two springs 422 form the outer housing of the vibration actuator 401. When utilized in the auditory prosthesis 400, the yoke 410, permanent magnets 418, counterweight 416, and magnetic rings 420 act as a seismic mass and vibrate. This vibration, in turn, is transmitted to the bobbin 402 that acts as a coupling mass and transmits the vibrations to the recipient R, via the output shaft 404.

Other components of the bone conduction device 400 are depicted in FIG. 4. The vibration actuator 401 is disposed in a housing 452. As with the previous embodiments, not all of the internal components of the bone conduction device 400 are depicted. The bone conduction device 400 includes an electronics module 454 (having a controller and one or more detectors) and a sound input element 456, such as a microphone. Both of these components can be resiliently secured to the housing 452 to minimize feedback caused by vibration of a vibration actuator 401. The output shaft 404 transfers vibration stimulus from the vibration actuator 458 to the recipient R, via a coupling element 462 and a bone screw 464 anchored in the skull of the recipient R. A control button 466 is disposed on the housing 452 and can include a number of sub-parts or elements. For example, control buttons such as those depicted and described above with regard to FIGS. 3A and 3B can be utilized. Here, the outermost element of the control button 466 is an engagement element 468 that includes an engagement surface 470, which is configured to be contacted by the recipient R. Pressing action on the control button 466 generates an axial force F along an axis A. An axial force F is transmitted along the axis A as described above. The engagement element 468 is connected to the housing 452 with a semi-resilient or flexible seal 472.

The control button 466 is separated from the output shaft 404 by a gap G, when the engagement element 468 is not depressed. An input 476 is in contact with the engagement element 468 and disposed in the gap G is a damper 480. When the engagement element 468 is depressed, a signal is sent from the input 476 to the electronics module 454, which is in communication therewith. A flexible shaft seal 478 can also be disposed about the actuator shaft 460 proximate the collar 462, so vibrations transmitted by the actuator shaft 460 to the recipient R are not transmitted to the housing 452, which further reduces the potential for feedback and distortion.

Figure 5A:
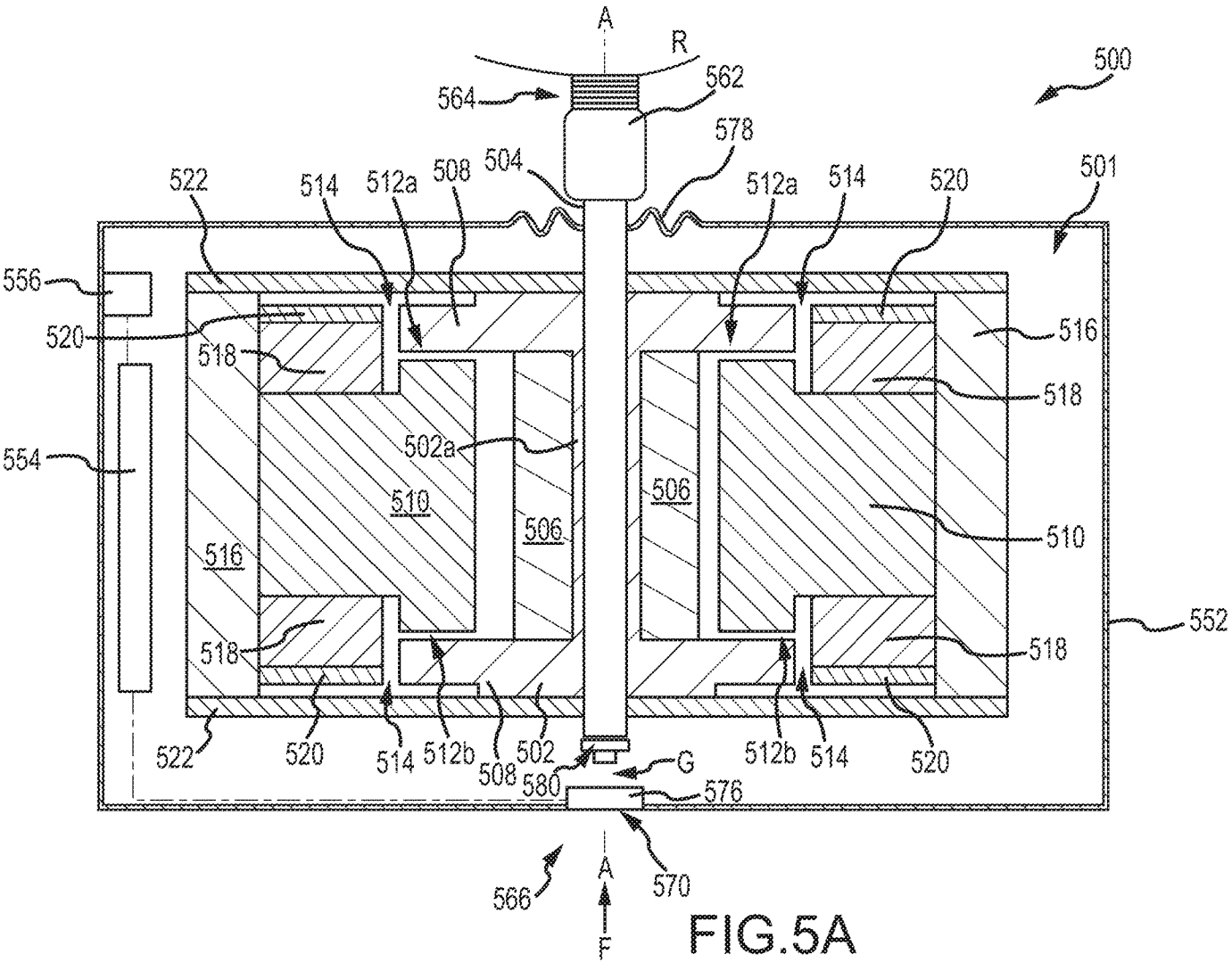
FIGS. 5A-5B are cross-sectional schematic views of another embodiment of a bone conduction device and a vibration actuator, worn on a recipient.
Figure 5B:
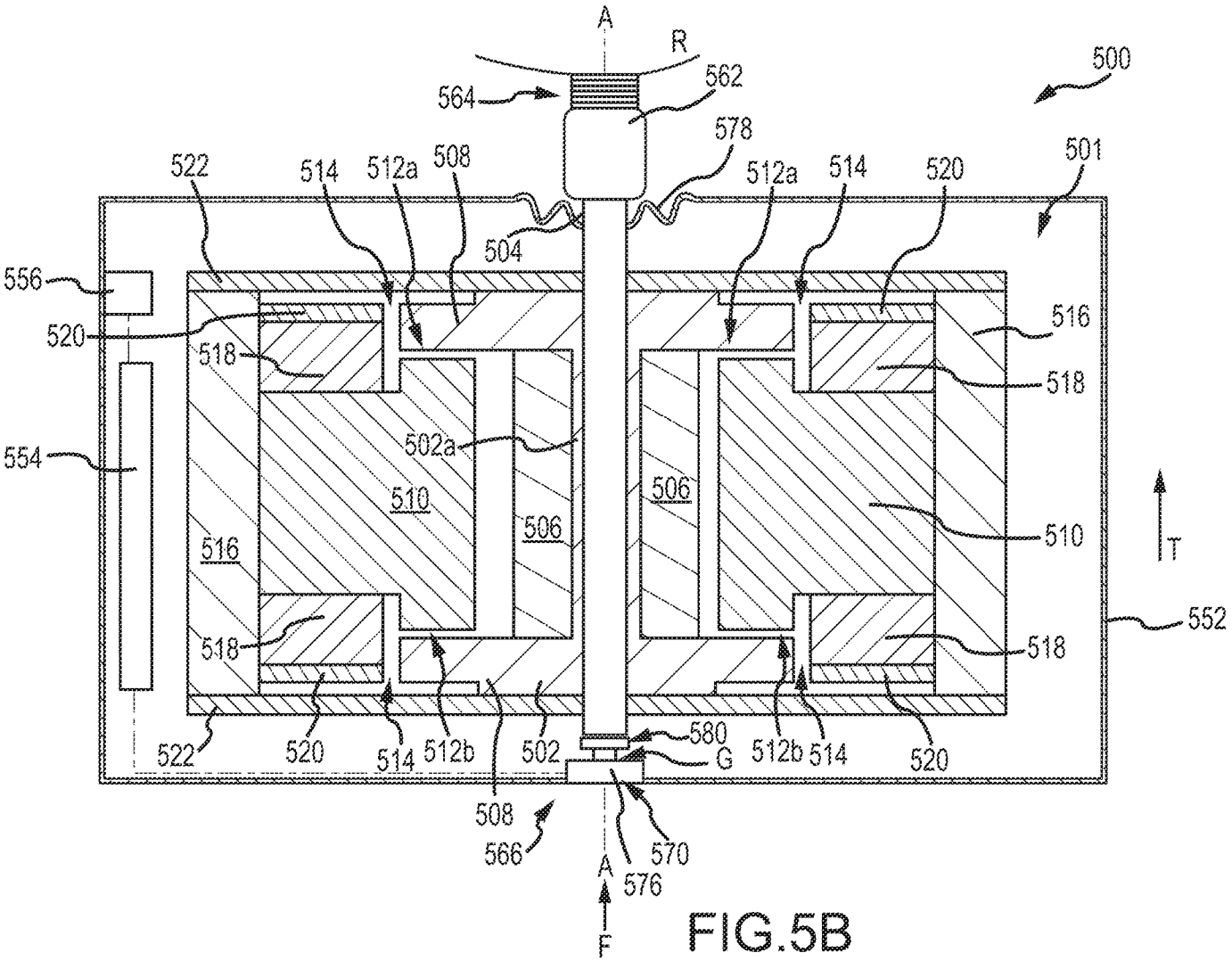

FIGS. 5A-5B are cross-sectional schematic views of another embodiment of a bone conduction device 500, worn on a recipient R. FIGS. 5A-5B also depict a cross-sectional view of a variable reluctance electromagnetic vibration actuator 501 disposed therein. Many of the components of vibration actuator 501 are described above with regard to FIG. 4 and are therefore not necessarily described further. In the depicted bone conduction device 500, the housing 552 is configured to act as the control button 566 and is movable relative to the vibration actuator 501. In this case, the control button 566 includes, an engagement surface 570 formed on an outer surface of the housing 552. The engagement surface 570 can include a raised or recessed pattern, texture, or other tactile feature that will enable the recipient to properly apply a force F thereto, along an axis A. The control button 566 further includes an input 576. A damper 580 is disposed on the output shaft 504 such that a gap G is disposed between the damper 580 and the input 576. FIG. 5B depicts the bone conduction device 500 when the force F has been exerted on the engagement surface 570 (e.g., when the engagement surface 570 has been pressed by the recipient R). The exerted force F causes the housing 552 to translate T along the axis A. This places the damper 580 in contact with the input 576, thus sending a signal from the input 576 to the electronics module 554. The output shaft 504, as connected to the collar 562 and bone screw 564, provides an axial resistance opposite the force F. The translation T also causes deflection of the flexible shaft seal 578 about the output shaft 504.

Figure 6A:
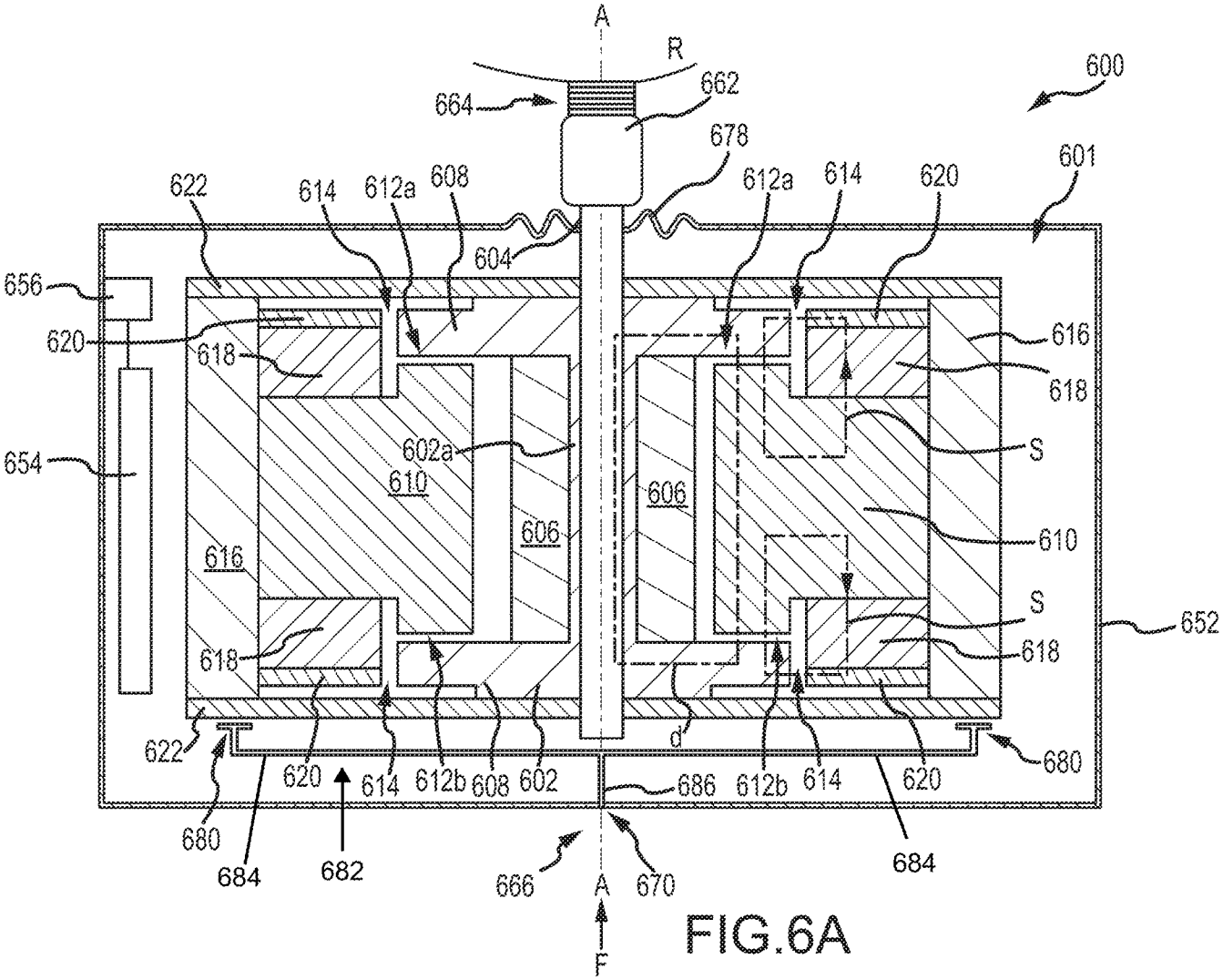
FIGS. 6A-6B are cross-sectional schematic views of another embodiment of a bone conduction device and a vibration actuator, worn on a recipient.
Figure 6B:
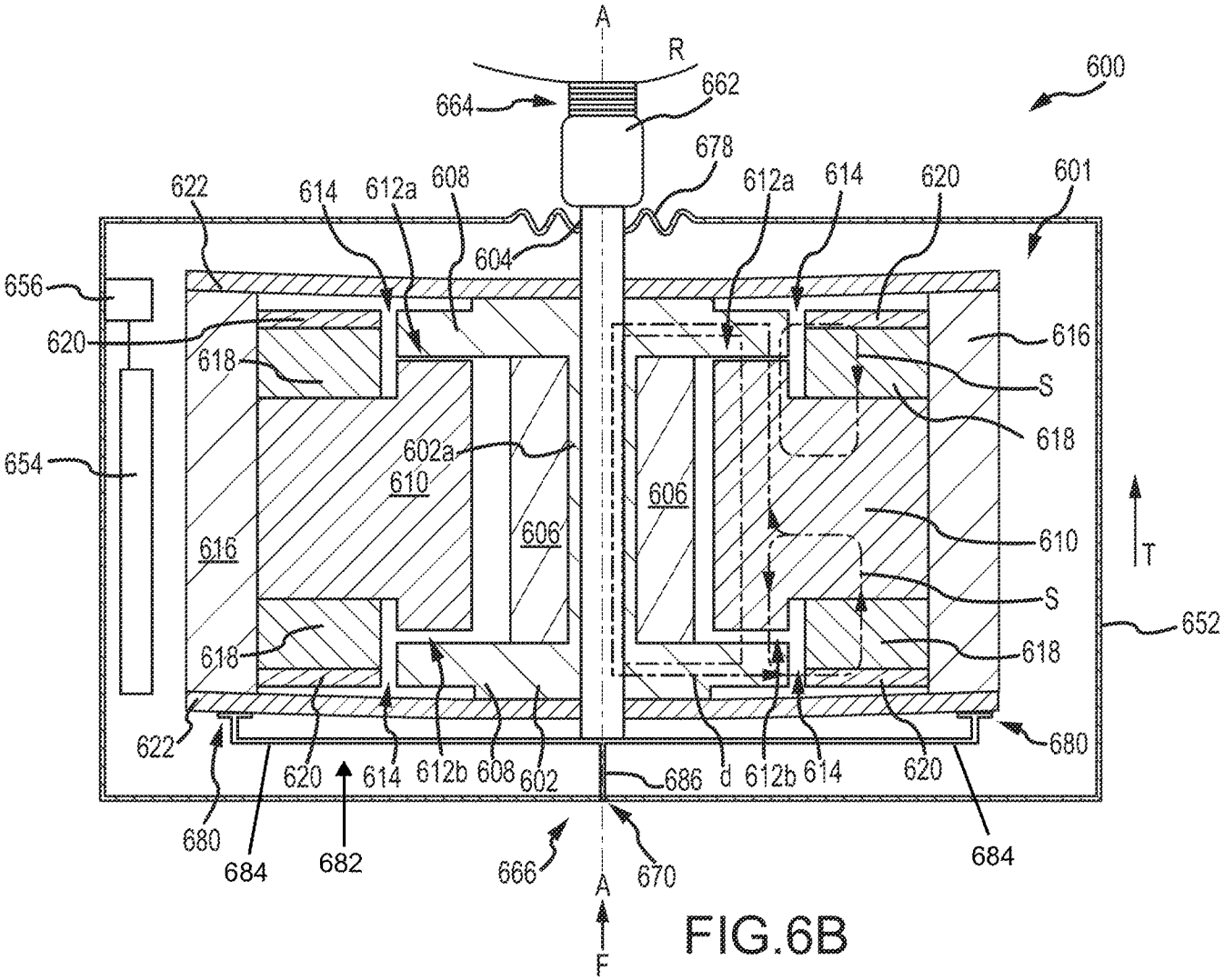

FIGS. 6A-6B are cross-sectional schematic views of another embodiment of a bone conduction device 600, worn on a recipient R. FIGS. 6A-6B also depict a cross-sectional view of a variable reluctance electromagnetic vibration actuator 601 disposed therein. Many of the components of vibration actuator 601 are described above with regard to FIG. 4 and are therefore not necessarily described further. In the depicted bone conduction device 600, the housing 652 is configured to act as the control button 666 and is movable relative to the vibration actuator 601. In this case, the control button 666 includes, in addition to the housing 652, an engagement surface 670 formed on an outer surface of the housing 652. The engagement surface 670 can include a raised or recessed pattern, texture, or other tactile feature that will enable the recipient to properly apply a force F thereto, along an axis A. In an alternative embodiment, a discrete control button configuration, such as depicted in FIG. 3A, 3B or 4, can be utilized. In this embodiment, the control button 666 also includes a strut structure 682 that includes a number of elongate members 684 extending from a hub 686 disposed proximate the engagement surface 670. Dampers 680 can be disposed proximate the end of each elongate member 684. Thus, the force F applied to the engagement surface 670 is distributed evenly to the vibration actuator 601 itself, causing a flexure of the springs 622 that form the outer housing of the vibration actuator 601. This condition is depicted in FIG. 6B. The translation T causes deflection of the flexible shaft seal 678 about the output shaft 604. The exerted force F causes the entire housing 652 to translate T along the axis A. This places the strut structure 682 in contact with the springs 622 that form the flexible outer housing of the vibration actuator 601. This contact deflects the springs 622, which causes a change in magnet flux within the vibration actuator 601, as described below.

In FIG. 6A, the axial air gaps 612*a*, 612*b* are substantially the same (that is, the distance between the yoke 610 and plate 608 at upper axial air gap 612*a* and lower axial air gap 612*b* are substantially similar). Contrast that condition with FIG. 6B, where the upper axial air gap 612*a* is smaller than the lower axial air gap 612*b* due to the applied force F and the resulting deflection of the springs 622 of the vibration actuator 601. These unequal air gaps 612*a*, 612*b* cause a distortion in an output signal sent from the coil 606. Any distortion of an output signal can be used to indicate the position of the yoke 510 relative to the bobbin 602, because the distortion is related to the amount of static magnetic flux S through the bobbin core 602*a* (as described in more detail below). FIG. 6A, however, depicts a balanced state, where no such static magnetic flux S passes through the core 602*a* of the bobbin 602. In this condition, the magnetic forces are equal in magnitude, and both axial air gaps 612*a*, 612*b* are about equal in size (if the design of the vibration actuator 601 is symmetric).

If the widths of the air gap 612*a*, 612*b* are dissimilar, a static magnetic flux S will propagate through the bobbin core 602*a*, as depicted in FIG. 6B. Here, the vibration actuator 601 is in an unbalanced state, due to the deflection of the springs 622 caused by the force F being applied to the engagement surface 670. If there is a certain amount of static magnetic flux S propagating through the bobbin core 602*a* (as depicted in FIG. 6B), there is likely to be a difference in the change of the total flux depending on whether a dynamic magnetic flux D is coinciding or opposing the static magnetic flux S. The dynamic magnetic flux D is present due to the magnetic field generated by the current flowing through the actuator coil 606. If the dynamic magnetic flux D is coinciding with the static magnetic flux S, the total flux is likely to differ from the static magnetic flux S less than conditions where the dynamic magnetic flux D is opposing the static magnetic flux S. This difference in flux is detected by a detector in the electronics module 654 and is registered as a push of the control button 666.

This disclosure described some aspects of the present technology with reference to the accompanying drawings, in which only some of the possible embodiments were shown. Other aspects, however, can be embodied in many different forms and should not be construed as limited to the embodiments set forth herein. Rather, these embodiments were provided so that this disclosure was thorough and complete and fully conveyed the scope of the possible embodiments to those skilled in the art.

Although specific aspects were described herein, the scope of the technology is not limited to those specific aspects. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

a housing;

a vibration actuator disposed in the housing;

an actuator shaft, wherein the vibration actuator is disposed around the actuator shaft; and a control button disposed on the housing, wherein the vibration actuator, the actuator shaft, and the control button are axially aligned, wherein when the control button is in a first position, a gap is present between the control button and the actuator shaft, and wherein when the control button is in a second position, the control button and the actuator shaft are in contact.

2. The apparatus of claim 1, wherein the control button is flexibly connected to the housing.

3. The apparatus of claim 1, wherein at least one of the control button and the actuator shaft comprises.

4. The apparatus of claim 1, wherein at least one of the control button and the actuator shaft comprises a contact element.

5. The apparatus of claim 4, wherein when the control button and the actuator shaft are in the second position, a signal is sent from the contact element to a controller.

6. The apparatus of claim 1, wherein the control button is integral with the housing.

7. An apparatus comprising a housing, an actuator shaft;

a vibration actuator substantially surrounding the actuator shaft; and a control button disposed on the housing, wherein the button is configured to apply a force to at least one of the actuator shaft and the vibration actuator, when a load is exerted on the control button, wherein the control button comprises a strut structure for distributing the applied force to the vibration actuator so as to prevent a moment about the actuator shaft; and wherein when the control button is in a first position, a gap is present between the strut structure and the vibration actuator, and wherein when the control button is in a second position, the strut structure and the vibration actuator are in contact.

8. The apparatus of claim 7, wherein the vibration actuator comprises a flexible housing and wherein the applied force deflects the flexible housing.

9. The apparatus of claim 8, wherein the flexure of the flexible housing alters a magnetic flux within the flexible housing, and wherein the apparatus further comprises a detector for detecting the altered magnetic flux and sending a signal to a controller based on the detection.

10. The apparatus of claim 7, wherein the control button is flexibly connected to the housing.

11. The apparatus of claim 7, wherein the control button is integral with the housing.

* * * * *